US006622978B1

(12) United States Patent
Ghiz

(10) Patent No.: US 6,622,978 B1
(45) Date of Patent: Sep. 23, 2003

(54) TOOTHBRUSH HOLDER AND METHOD OF USING

(76) Inventor: Scott A. Ghiz, 6072 Carversville Ro, Doylestown, PA (US) 18901

( * ) Notice: Subject to any disclaimer, the term of this patent is extended or adjusted under 35 U.S.C. 154(b) by 0 days.

(21) Appl. No.: 10/164,938

(22) Filed: Jun. 6, 2002

(51) Int. Cl.[7] ..... A46B 17/02
(52) U.S. Cl. ..... 248/110; 211/65; 248/153
(58) Field of Search ..... 248/110, 683, 248/112, 111, 205.5, 206.2, 302, 153; 211/65

(56) References Cited

U.S. PATENT DOCUMENTS

| | | | | | |
|---|---|---|---|---|---|
| 1,487,085 | A | * | 3/1924 | Blackshear | 211/65 |
| 1,695,185 | A | * | 12/1928 | Gale | 211/65 |
| 2,051,847 | A | * | 8/1936 | Halstead | 312/206 |
| RE21,391 | E | * | 3/1940 | Holden | 248/75 |
| 2,472,058 | A | * | 6/1949 | Artley | 211/13.1 |
| 2,703,689 | A | * | 3/1955 | Williams | 248/153 |
| 3,186,671 | A | * | 6/1965 | Standley | 248/302 |
| 3,685,660 | A | * | 8/1972 | Saunders | 211/70.1 |
| 4,854,457 | A | * | 8/1989 | Perler | 211/65 |
| 5,163,566 | A | * | 11/1992 | Hempel | 211/65 |
| D428,746 | S | * | 8/2000 | Patel et al. | D6/531 |
| 6,330,948 | B1 | * | 12/2001 | Leto | 211/70.6 |
| 6,523,705 | B2 | * | 2/2003 | Henderson et al. | 211/74 |

FOREIGN PATENT DOCUMENTS

DE 422702 C1 * 1/1994

* cited by examiner

*Primary Examiner*—Anita King

(57) ABSTRACT

A new and improved toothbrush holder device and method of using is described which can support a toothbrush in a cantilever fashion so that the toothbrush can be allowed to hygienically air dry without touching the bristles onto any surface. The toothbrush holder comprises a unitary length of wire bent into various figure eight configurations that have a first loop; a second loop and a arcuately-curved portion having a crossover point therebetween. The second loop is aligned outside the plane of the first loop. A toothbrush may be held within the toothbrush holder by cantilever suspending the toothbrush handle over the crest of the first loop and below the crossover point. The toothbrush holder may either be horizontally or vertically mounted onto a support surface. The stand alone embodiment of the toothbrush holder may be supported onto a horizontal surface with the second loop directly contacting the support surface such as a cabinet or a sink top surface. A suction cup attached to the second loop allows the toothbrush holder to be mounted onto vertical support surfaces such as mirrors or bathroom walls. The method of using the new and improved toothbrush holder comprises obtaining, cleaning, wetting, sticking and inserting.

17 Claims, 3 Drawing Sheets

TOOTHBRUSH HOLDER AND METHOD OF USING

FIELD OF THE INVENTION

The present invention relates in general to holders for articles such as toothbrushes and more particularly relates to sanitized toothbrush holders incorporating inexpensive designs which are capable of hygienically holding a toothbrush in a cantilever manner so that the bristles do not touch any surface.

DESCRIPTION OF THE PRIOR ART

A number of arrangements have been suggested in the prior art for providing sanitized or hygienic holders for toothbrushes to overcome the objectional features of conventional toothbrush holders such as slotted plates in which the bristles contact the support surfaces. Among these arrangements are the provisions for a combination of flexible plates formed with at least one pair of upper and lower openings as disclosed Sauders in U.S. Pat. No. 3,685,660. The tube and instrument holder disclosed by Artley in U.S. Pat. No. 2,472,058 discloses a device having a base member having a lower free end portion bent outwardly to provide a shelf and two elongated members spaced apart and secured to the back of the base member to provide a means for holding a toothbrush. The Wire toothbrush holder disclosed by Patel and Hauser in U.S. Pat No. D428,746 discloses a device which allows the bristles of the toothbrush to be in direct contact with the disclosed toothbrush holder. The hygienic magnetic toothbrush holder disclosed by Hempel in U.S. Pat. No. 5,163,566 in U.S. Pat. No. 5,163,566 discloses a device which magnetically holds a toothbrush. The hygienic toothbrush holder disclosed by Perler in U.S. Pat. No. 4,854,457 discloses a structure for holding multiple toothbrushes in such a way as to clip the toothbrush holder and thus allow for the toothbrush to hygienically air dry.

While all of the above-described devices fulfill their respective, particular objectives and requirements, the aforementioned patents do not describe a unitary length of wire bent into various figure eight configurations so that a toothbrush may be cantilever suspended over the crest of a first loop and under a crossover point in the figure eight structure. This figure eight design that would specifically match the user's particular individual needs for providing an inexpensive toothbrush holder which is hygienically sound because it allows the toothbrush bristles to air dry without touching any support surfaces. The above-described patents make no provision for the above described elements in a toothbrush holder.

Therefore, a need exists for a new and improved toothbrush holder that can be used for providing an inexpensive toothbrush holder which is hygienically sound because it allows the toothbrush bristles to air dry without touching any support surfaces. In this respect, the toothbrush holder according to the present invention substantially departs from the conventional concepts and designs of the prior art, and in doing so provides an apparatus primarily developed for the purpose of providing a design that comprises a unitary length of wire bent into various figure eight configurations so that a toothbrush may be cantilever suspended over the crest of a first loop and under a crossover point in the figure eight structure. This figure eight design would provide an inexpensive toothbrush holder means for hygienically storing a toothbrush because it would allows the toothbrush bristles to air dry without touching any support surfaces.

SUMMARY OF THE INVENTION

A toothbrush holder is described which can support a toothbrush in a cantilever fashion so that the toothbrush can be allowed to hygienically air dry without touching the bristles onto any surface. The toothbrush holder comprises a unitary length of wire bent into various figure eight configurations which have a first loop; a second loop and a arcuately-curved portion having a crossover point therebetween. The second loop is aligned outside the plane of the first loop. A toothbrush may be held within the toothbrush holder by cantilever suspending the toothbrush handle over the crest of the first loop and below the crossover point. The toothbrush holder may either be horizontally or vertically mounted onto a support surface. The stand alone embodiment of the toothbrush holder may be supported onto a horizontal surface with the second loop directly contacting the support surface such as a cabinet or a sink top surface. A suction cup attached to the second loop allows the toothbrush holder to be mounted onto vertical support surfaces such as mirrors or bathroom walls.

In view of the foregoing disadvantages inherent in the known type toothbrush holders now present in the prior art, the present invention provides an improved toothbrush holder, which will be described subsequently in great detail, is to provide a new and improved toothbrush holder which is not anticipated, rendered obvious, suggested, or even implied by the prior art, either alone or in any combination thereof.

To attain this, the present invention essentially comprises a unitary length of wire bent into various figure eight configurations that have a first loop; a second loop and an arcuately-curved portion having a crossover point therebetween. The second loop is aligned outside the plane of the first loop. The alignment of the two loops with the crossover point of the toothbrush holders allow a toothbrush to be held by cantilever suspending the toothbrush handle over the crest of the first loop and below the crossover point. The toothbrush holder may either be horizontally or vertically mounted onto a support surface. The stand-alone embodiment of the toothbrush holder may be supported onto a horizontal surface with the second loop directly contacting the support surface such as a cabinet or a sink top surface. A suction cup attached to the second loop allows the toothbrush holder to be mounted onto vertical support surfaces such as mirrors or bathroom walls.

There has thus been outlined, rather broadly, the more important features of the invention in order that the detailed description thereof that follows may be better understood, and in order that the present contribution of the art may be better appreciated.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toothbrush holder that has all the advantages of the prior art toothbrush holder and none of the disadvantages.

It is another object of the present invention to provide a new and improved toothbrush holder that may be easily and efficiently manufactured and marketed.

An even further object of the present invention is to provide a new and improved toothbrush holder that has a low cost of manufacture with regard to both wires and labor, and which accordingly is then susceptible of low prices of sale to the consuming public, thereby making such multipurpose storage unit and system economically available to the buying public.

Still another object of the present invention is to provide a new toothbrush holder that provides in the apparatuses and methods of the prior art some of the advantages thereof, while simultaneously overcoming some of the disadvantages normally associated therewith.

Even still another object of the present invention is to provide a toothbrush holder having a figure eight shape. This makes it possible to hygienically hold the toothbrush by cantilevering the toothbrush over the crest of the first loop and below the cross over point.

Yet another object of the present invention is to provide a toothbrush holder having a figure eight shape attached to a suction cup. This makes it possible to mount the toothbrush holder onto any suitable smooth support surface such as a mirror or a bathroom wall.

Lastly, it is an object of the present invention to provide a new and improved method for using the new and improved toothbrush holder comprises obtaining, cleaning, wetting, sticking and inserting.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
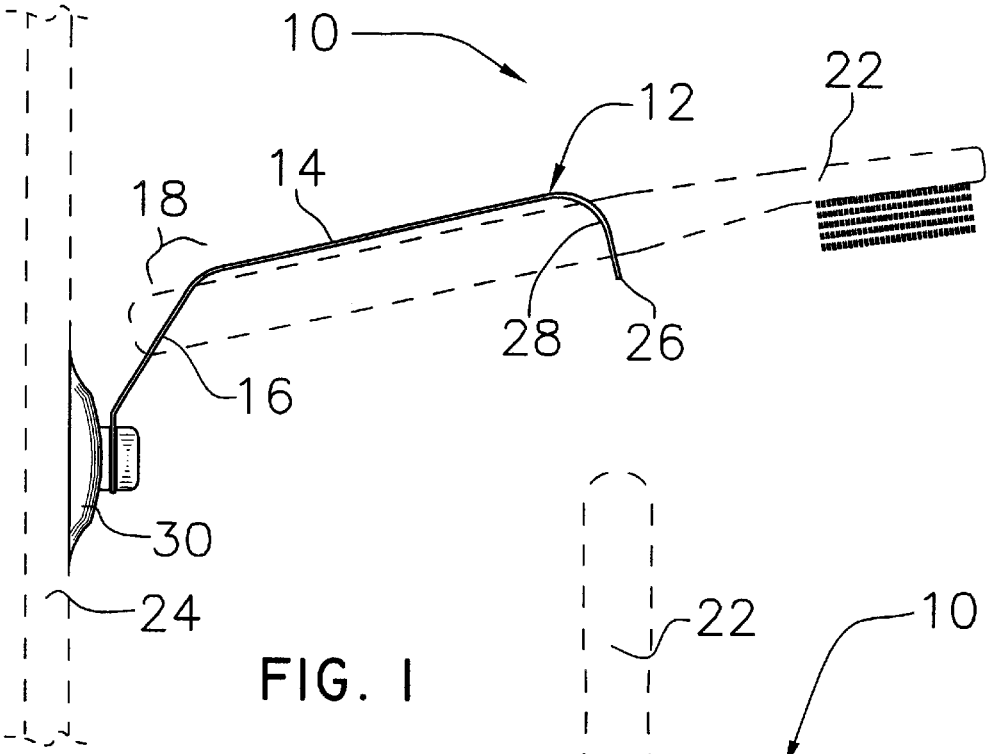
FIG. 1 is a perspective view of one of the preferred embodiment of the toothbrush holder constructed in accordance with the principles of the present invention showing a supporting surface in dotted lines and a toothbrush in dotted lines.
Figure 2:
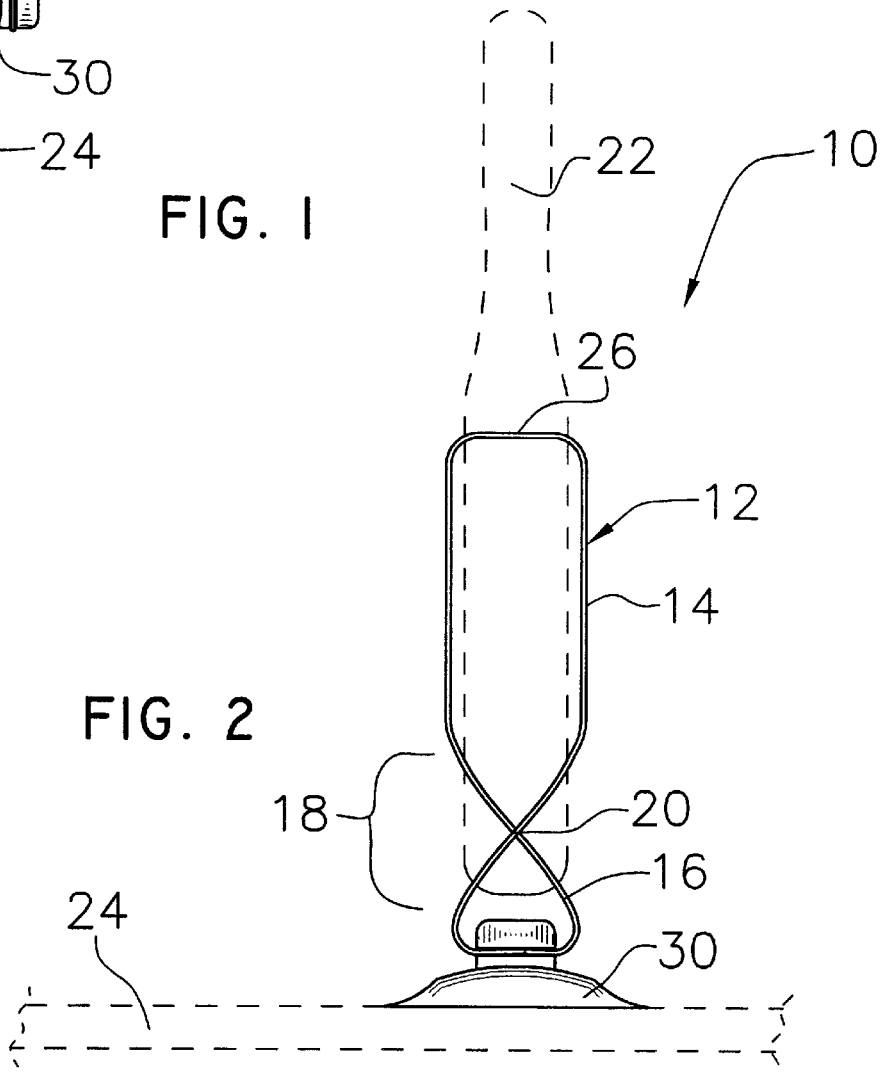
FIG. 2 is an overhead view of the toothbrush holder of the present invention showing a supporting surface in dotted lines and a toothbrush in dotted lines.
Figure 5:
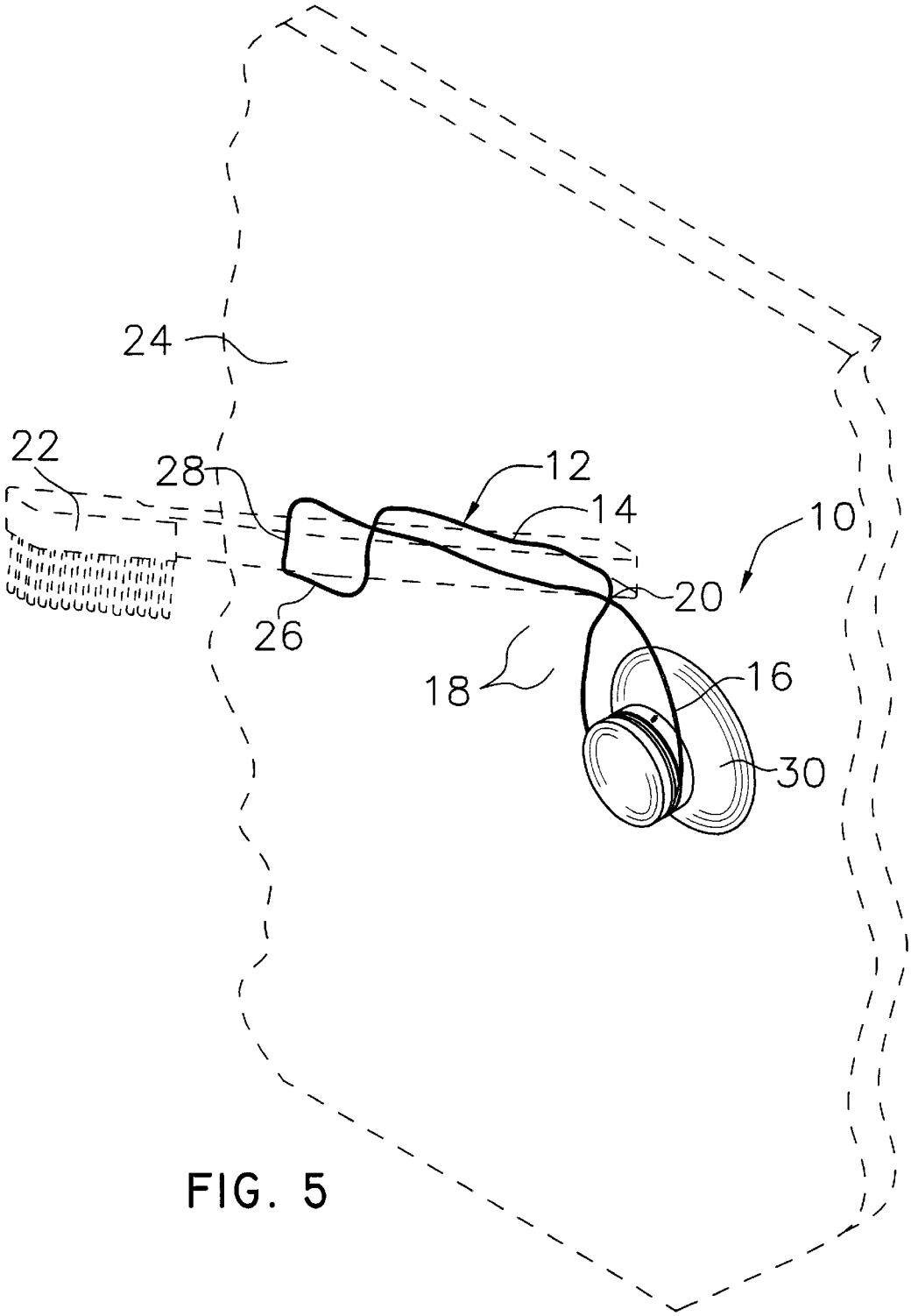
FIG. 5 is a perspective view of one of the embodiments of the toothbrush holder of the present invention showing a supporting surface in dotted lines and a toothbrush in dotted lines.

Referring now to the drawings, and in particular FIG. 1, FIG. 2 and FIG. 5, one preferred embodiment of the present invention is shown and generally designated by the reference numeral 10. This preferred embodiment of the present invention of a toothbrush holder 10 comprises: a unitary length of wire 12 bent into a figure eight configuration attached to a suction cup 30. The unitary length of wire 12 is bent into a figure eight configuration having: a first loop 14; a second loop 16, the second loop 16 positioned outside the plane of the first loop 14; and arcuately curved portion 18 having a crossover point 20 therebetween the first loop 14 and the second loop 16. The suction cup 30 is attached to the second loop 16, in which the crossover point 20 and the first loop 14 are capable of securely suspending a toothbrush 22 in a cantilever manner when the suction cup 30 contacts a support surface 24 such as a mirror or a wall.

Also referring now to the drawings, and in particular FIG. 1, FIG. 2 and FIG. 5, another preferred embodiment of the present invention of a toothbrush holder 10 comprises: a unitary length of wire 12 bent into a figure eight configuration attached to a suction cup 30. The unitary length of wire 12 is bent into a figure eight configuration having: a first loop 14, a second loop 16, and arcuately-curved portion 18. The first loop 14 having a longitudinally elongated shape with a substantially linear crest 26 and having a downwardly bent front end portion 28. The second loop 16 having a substantially rectangular shape and the second loop 16 positioned outside the plane of the first loop 14. The arcuately-curved portion 18 having a crossover point 20 therebetween the first loop 14 and the second loop 16. The suction cup 30 is attached to the second loop 16 in which the crossover point 20 and the first loop 14 are capable of securely suspending a toothbrush 22 in a cantilever manner when the suction cup 30 contacts a support surface 24.

Figure 3:
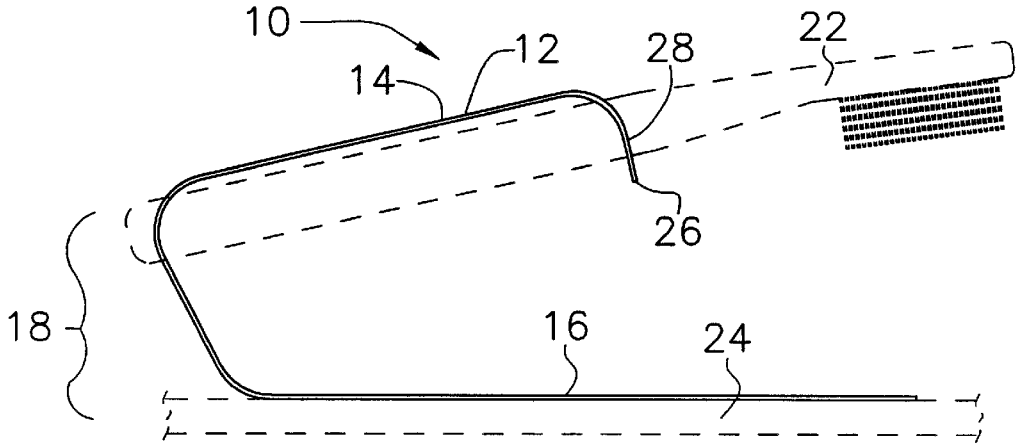
FIG. 3 is a side view of one of the stand-alone embodiments of the toothbrush holder of the present invention showing a supporting surface in dotted lines and a toothbrush in dotted lines.
Figure 4:
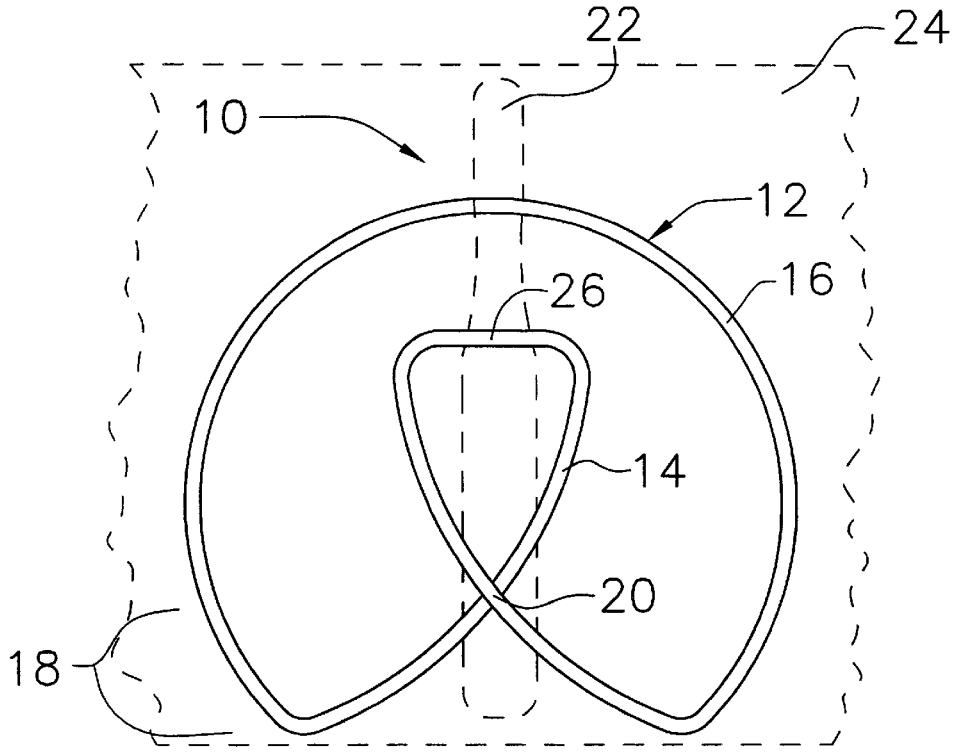
FIG. 4 is a top view of one of the stand-alone embodiments of the toothbrush holder of the present invention showing a supporting surface in dotted lines and a toothbrush in dotted lines.

Referring now to the drawings, and in particular FIG. 3 and FIG. 4 thereof, another preferred embodiment of the toothbrush holder 10 comprises: a unitary length of wire 12 bent into a figure eight configuration having: a first loop 14;

a second loop 16, the second loop 16 positioned outside the plane of the first loop 14; and arcuately-curved portion 18 having a crossover point 20 therebetween the first loop 14 and the second loop 16. The crossover point 20 and the first loop 14 are capable of securely suspending a toothbrush 22 in a cantilever manner when the second loop 16 contacts a support surface 24.

One preferred embodiment of the method of using the new and improved toothbrush holder 10 of the present invention comprises the steps of obtaining, cleaning, sticking, and inserting. The obtaining step comprises obtaining: a unitary length of wire 12 bent into a figure eight configuration attached to a suction cup 30. The unitary length of wire 12 is bent into a figure eight configuration having: a first loop 14, a second loop 16, and arcuately-curved portion 18. The first loop 14 having a longitudinally elongated shape with a substantially linear crest 26 and having a downwardly bent front end portion 28. The second loop 16 having a substantially rectangular shape and the second loop 16 positioned outside the plane of the first loop 14. The arcuately-curved portion 18 having a crossover point 20 therebetween the first loop 14 and the second loop 16. The suction cup 30 is attached to the second loop 16 in which the crossover point 20 and the first loop 14 are capable of securely suspending a toothbrush 22 in a cantilever manner when the suction cup 30 contacts a support surface 24. The cleaning step comprises cleaning an area on a mirror. The wetting step comprises wetting the suction cup with water. The sticking step comprises sticking the wetted suction cup onto the cleaned area on a mirror. The inserting step comprises inserting the handle of the toothbrush through the first and second loops with the crossover point above the handle of the toothbrush.

The exact dimensions of the toothbrush holder 10 are not restricted in any way. That is, the relative size of either loop may be larger or smaller than the other loop. One stand along embodiment comprises a second loop 16 that is optionally larger than the first loop 14. Another embodiment comprises the first loop 14 that is optionally larger than the second loop. Furthermore, the shapes of the loops should not be restricted to the illustrated examples in that the loops may take any number of different shapes. For example in one embodiment of the present invention of the toothbrush holder 10, the first loop 14 may be longitudinally elongated relative to its width, as compared to another embodiment of the present invention where the second loop is substantially triangular in shape. Yet even further, the first loop 14 may optionally have a crest 26 that is substantially linear. Also, the first loop 14 may optionally have a downwardly bent front end portion 28 containing the crest 26 of the first loop 14.

The toothbrush holder 10 may be composed of any commercially available material such as a metal wire or made of plastic or comprised of a metal wire coated with plastic. The wire 12 may be made of corrosion resistant metal or plastic.

Referring now to FIG. 1, a new and improved toothbrush holder unit 10 of the present invention for hygienically holding a toothbrush is illustrated and will be described. More particularly, a perspective view of the toothbrush holder 10 constructed in accordance with the principles of the present invention is shown. Also shown is a supporting surface in dotted lines and a toothbrush in dotted lines. The present invention of the toothbrush holder 10 comprises: a unitary length of wire 12 bent into a figure eight configuration attached to a suction cup 30. The unitary length of wire 12 is bent into a figure eight configuration having: a first loop 14, a second loop 16, and arcuately-curved portion 18. The first loop 14 having a longitudinally elongated shape with a substantially linear crest 26 and having a downwardly bent front end portion 28. The second loop 16 having a substantially rectangular shape and the second loop 16 positioned outside the plane of the first loop 14. The arcuately-curved portion 18 having a crossover point 20 therebetween the first loop 14 and the second loop 16. The suction cup 30 is attached to the second loop 16 in which the crossover point 20 and the first loop 14 are capable of securely suspending a toothbrush 22 in a cantilever manner when the suction cup 30 contacts a support surface 24. Also shown is the first loop 14 having the optional downwardly bent front end portion 28 containing the crest 26 of the first loop 14, so that the toothbrush 22 may be cantilevered over the crest 26 and below the cross-over point 20.

Referring now to FIG. 2, an overhead view of the toothbrush holder 10 of the present invention is shown. Also shown is a supporting surface 24 in dotted lines and a toothbrush 22 in dotted lines. The toothbrush holder 10 comprises a unitary length of wire 12 bent into a figure eight configuration attached to a suction cup 30. The unitary length of wire 12 is bent into a figure eight configuration having: a first loop 14; a second loop 16, the second loop 16 positioned outside the plane of the first loop 14; and arcuately-curved portion 18 having a crossover point 20 therebetween the first loop 14 and the second loop 16. The suction cup 30 is attached to the second loop 16, in which the crossover point 20 and the first loop 14 are capable of securely suspending a toothbrush 22 in a cantilever manner when the suction cup 30 contacts a support surface 24 such as a mirror or a wall. Also shown is the first loop 14 having the optional have a Crest 26 which is substantially linear so that the toothbrush 22 may be cantilevered over the crest 26 and below the cross-over point 20.

Refer now to FIG. 3, which is a side view of one of the stand-alone embodiments of the toothbrush holder of the present invention showing a supporting surface 24 in dotted lines and a toothbrush 22 in dotted lines. This embodiment of the present invention of the toothbrush holder 10 comprises a unitary length of wire 12 bent into a figure eight configuration having: a first loop 14; a second loop 16, the second loop 16 positioned outside the plane of the first loop 14; and arcuately-curved portion 18 having a crossover point 20 therebetween the first loop 14 and the second loop 16. The crossover point 20 and the first loop 14 are capable of securely suspending a toothbrush 22 in a cantilever manner when the second loop 16 contacts a support surface 24. The first loop 14 is shown having an elongated length of at least half the length of the second loop 16. Also shown is the first loop 14 having the optional downwardly bent front end portion 28 containing the crest 26 of the first loop 14, so that the toothbrush 22 may be cantilevered over the crest 26 and below the cross-over point 20. The toothbrush holder 10 stand-alone position is achieved by having the second loop 16 directly contact the support surface 24.

Referring now to FIG. 4, which is a top view of one of the stand-alone embodiments of the toothbrush holder 10 of the present invention showing a supporting surface 24 in dotted lines and a toothbrush 22 in dotted lines. This preferred embodiment of the toothbrush holder 10 comprises: a unitary length of wire 12 bent into a figure eight configuration having: a first loop 14; a second loop 16, the second loop 16 positioned outside the plane of the first loop 14; and arcuately-curved portion 18 having a crossover point 20 therebetween the first loop 14 and the second loop 16. The crossover point 20 and the first loop 14 are capable of securely suspending a toothbrush 22 in a cantilever manner when the second loop 16 contacts a support surface 24. The toothbrush holder 10 is shown in a stand-alone configuration that allows the second loop 16 to directly contact the support surface 24. Also shown is the first loop 14 having the optional have a crest 26 which is substantially linear so that the toothbrush 22 may be cantilevered over the crest 26 and below the cross-over point 20.

Referring now to FIG. 5, which is a perspective view of one of the embodiments of the toothbrush holder 10 of the present invention showing a supporting surface in dotted lines and a toothbrush in dotted lines. The present invention of the toothbrush holder 10 comprises: a unitary length of wire 12 bent into a figure eight configuration attached to a suction cup 30. The unitary length of wire 12 is bent into a figure eight configuration having: a first loop 14, a second loop 16, and arcuately-curved portion 18. The first loop 14 having a longitudinally elongated shape with a substantially linear crest 26 and having a downwardly bent front end portion 28. The second loop 16 having a substantially rectangular shape and the second loop 16 positioned outside the plane of the first loop 14. The arcuately-curved portion 18 having a crossover point 20 therebetween the first loop 14 and the second loop 16. The suction cup 30 is attached to the second loop 16 in which the crossover point 20 and the first loop 14 are capable of securely suspending a toothbrush 22 in a cantilever manner when the suction cup 30 contacts a support surface 24. The first loop 14 is longitudinally elongated relative to its width and the second loop 16 is substantially triangular in shape. Also shown is the first loop 14 having the optional downwardly bent front end portion 28 containing the crest 26 of the first loop 14, so that the toothbrush 22 may be cantilevered over the crest 26 and over the cross-over point 20.

As to the manner of usage and operation of the present invention, the same should be apparent from the above description. Accordingly, no further discussion relating to the manner of usage and operation will be provided.

While a preferred embodiment of the toothbrush holder has been described in detail, it should be apparent that modifications and variations thereto are possible, all of which fall within the true spirit and scope of the invention. With respect to the above description then, it is to be realized that the optimum dimensional relationships for the parts of the invention, to include variations in size, wires, shape, form, function and manner of operation, assembly and use, are deemed readily apparent and obvious to one skilled in the art, and all equivalent relationships to those illustrated in the drawings and described in the specification are intended to be encompassed by the present invention. For example, any sturdy wire material such as metal or plastic may be used.

With respect to the above description then, it is to be realized that the optimum dimensional relationships for the parts of the invention, to include variations in size wires, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toothbrush holder comprising:

a unitary length of wire bent into a figure eight configuration having:

a first loop;

a second loop, said second loop positioned outside the plane of said first loop; and an arcuately-curved portion having a crossover point therebetween, wherein said crossover point and said first loop are capable of securely suspending a toothbrush in a cantilever manner when said second loop contacts a support surface.

2. The toothbrush holder described in claim 1 wherein said second loop is larger than said first loop.

3. The toothbrush holder described in claim 1 wherein said first loop is longitudinally elongated.

4. The toothbrush holder described in claim 1 wherein said first loop has a crest which is substantially linear.

5. The toothbrush holder described in claim 1 wherein said first loop has a downwardly bent front end portion containing the crest of said first loop.

6. The toothbrush holder described in claim 1 wherein said wire is a metal wire.

7. The toothbrush holder described in claim 1 wherein said wire is made of plastic.

8. The toothbrush holder described in claim 1 wherein said wire is a metal wire coated with plastic.

9. The toothbrush holder described in claim 1 wherein said wire is made of corrosion resistant metal or plastic.

10. A toothbrush holder comprising:

a unitary length of wire bent into a figure eight configuration having:

a first loop;

a second loop, said second loop positioned outside the plane of said first loop; and an arcuately-curved portion having a crossover point therebetween; and a suction cup attached to the second loop, wherein said crossover point and said first loop are capable of securely suspending a toothbrush in a cantilever manner when said suction cup contacts a support surface.

11. The toothbrush holder described in claim 10 wherein said first loop is larger than said second loop.

12. The toothbrush holder described in claim 10 wherein said first loop is longitudinally elongated.

13. The toothbrush holder described in claim 10 wherein said first loop has a crest that is substantially linear.

14. The toothbrush holder described in claim 10 wherein said first loop has a downwardly bent portion at the crest of said first loop.

15. The toothbrush holder described in claim 10 wherein said wire is a metal wire.

16. The toothbrush holder described in claim 10 wherein said wire is made of plastic.

17. A method of using a toothbrush holder for hygienically storing a toothbrush in the toothbrush holder, said method comprising the steps:

obtaining a toothbrush holder comprising:

a unitary length of wire bent into a figure eight configuration having:

a first loop, said first loop having a longitudinally elongated shape with a substantially linear crest and having a downwardly bent front end portion;

a second loop, said second loop having a substantially rectangular shape and said second loop positioned outside the plane of said first loop; and an arcuately-curved portion having a crossover point therebetween said first and second loops; and a suction cup attached to the second loop, wherein said crossover point and said first loop are capable of securely suspending a toothbrush in a cantilever manner when said suction cup contacts a support surface;

cleaning an area on a mirror;

wetting the suction cup with water;

sticking the wetted suction cup onto the cleaned area on a mirror; and inserting the handle of the toothbrush through the first and second loops with the crossover point above the handle of the toothbrush.

* * * * *